US006365096B1

(12) United States Patent
Sandberg et al.

(10) Patent No.: US 6,365,096 B1
(45) Date of Patent: Apr. 2, 2002

(54) STEEL MATERIAL FOR HOT WORK TOOLS

(75) Inventors: Odd Sandberg, Uddeholm; Bengt Klarenfjord, Ekshärad, both of (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 09/646,782

(22) PCT Filed: Feb. 18, 1999

(86) PCT No.: PCT/SE99/00217

§ 371 Date: Sep. 22, 2000

§ 102(e) Date: Sep. 22, 2000

(87) PCT Pub. No.: WO99/50468

PCT Pub. Date: Oct. 7, 1999

(30) Foreign Application Priority Data

Mar. 27, 1998 (SE) ..... 9801044

(51) Int. Cl.[7] ..... C33C 38/22; C33C 38/24
(52) U.S. Cl. ..... 420/111; 148/333
(58) Field of Search ..... 420/111; 148/334

(56) References Cited

U.S. PATENT DOCUMENTS 5,622,674 A 4/1997 Bourrat ..... 420/109

*Primary Examiner*—Deborah Yee
(74) *Attorney, Agent, or Firm*—Michael D. Bednarek; Shaw Pittman LLP

(57) ABSTRACT

A steel material for hot work tools has an alloy composition that in weight-% essentially consists of: 0.3–0.4 C, 0.2–0.8 Mn, 4–6 Cr, 1.8–3 Mo, 0.4–0.8 V, balance iron and unavoidable metallic and non-metallic impurities, said non-metallic impurities comprising silicon, nitrogen, oxygen, phosphor and sulfur, the contents of which does not exceed the following maximum contents: max. 0.25 Si, max. 0.010 N, max. 10 ppm O, max. 0.010 weight-% P.

12 Claims, 10 Drawing Sheets

| COOLING CURVE No | HARDNESS HV 10 | (SEC) |
|---|---|---|
| 1 | 681 | 1,5 |
| 2 | 627 | 15 |
| 3 | 620 | 280 |
| 4 | 592 | 1248 |
| 5 | 566 | 3205 |
| 6 | 488 | 5200 |
| 7 | 468 | 10400 |
| 8 | 464 | 20800 |
| 9 | 405 | 41600 |

| TEMP °C | TIME HOURS | HARDN. HV 10 |
|---|---|---|
| 800 | 14,7 | 514 |
| 775 | 23,5 | 483 |
| 750 | 64,2 | 172 |
| 725 | 20,5 | 202 |
| 700 | 17,4 | 207 |
| 675 | 22,7 | 253 |
| 650 | 7,6 | 649 |
| 400 | 2,4 | 715 |
| 375 | 1,7 | 707 |
| 350 | 2,8 | 579 |
| 325 | 2,0 | 560 |
| 300 | 2,2 | 530 |

STEEL MATERIAL FOR HOT WORK TOOLS

This application is a 371 of PCT/SE99/00217 filed Feb. 18, 1999.

TECHNICAL FIELD

The invention relates to a steel material for hot work tools, i.e. tool for forming or working metals at comparatively high temperatures.

TECHNICAL POSITION

The term 'hot work tools' is applied to a great number of different kinds of tools for the working or forming of metals at comparatively high temperatures, for example tools for die casting, such as dies, inserts and cores, inlet parts, nozzles, ejector elements, pistons, pressure chambers, etc.; tools for extrusion tooling, such as dies, die holders, liners, pressure pads and stems, spindles, etc.; tools for hot-pressing, such as tools for hot-pressing of aluminium, magnesium, copper, copper alloys and steel; moulds for plastics, such as moulds for injection moulding, compression moulding and extrusion; together with various other kinds of tools such as tools for hot shearing, shrink-rings/collars and wearing parts intended for use in work at high temperatures. There are a number of standard steel qualities used for these hot work tools, e.g. AISI Type H10-H19, and also several commercial special steels. Table 1 presents some of these standardised and/or commercial hot work steels.

invention is to offer optimal properties in terms of good hardenability and microstructure in order to provide high levels of toughness and ductility also in heavy gauges. At the same time there must be no deterioration of tempering resistance and high temperature strength.

More particularly, a purpose of the invention is to offer a hot work steel with a chemical composition that is such that the steel can satisfy the following demands:

- it must have good hot workability in order to thereby get a high yield on manufacture,
- it should be capable of manufacture in very heavy gauges, which means thicker than e.g. 760×410 mm or thicker than Ø 550 mm,
- it should have very low content of impurities,
- it should not contain any primary carbides,
- it should have good hot treatment properties, meaning inter alia that it should be capable of being tempered at a moderately high austenitizing temperature,
- it should have very good hardenability, i.e. it should be capable of being through-hardened even in the above-mentioned very heavy gauges,
- it should be form-stable during heat treatment,
- it should have good tempering resistance,
- it should have good high-temperature strength,
- it should have very good toughness and very good ductility properties in the dimension ranges in question,
- it should have good thermal conductivity,
- it should not have an unacceptably large coefficient of heat expansion,

TABLE I

| | | Nominal chemical composition by weight-percentage of known hot work steels | | | | | | | | | |
|---|---|---|---|---|---|---|---|---|---|---|---|
| Steel type | Steel no. | C | Si | Mn | Cr | Mo | W | Ni | V | Co | Fe |
| W.nr 1.2344/H13 | 1 | 0.40 | 1.0 | 0.40 | 5.3 | 1.4 | — | — | 1.0 | — | Bal. |
| W.nr 1.2365/H10 | 2 | 0.32 | 0.25 | 0.30 | 3.0 | 2.8 | — | — | 0.5 | — | " |
| W.nr 1.2885/H10A | 3 | 0.32 | 0.25 | 0.30 | 3.0 | 2.8 | — | — | 0.5 | 3.0 | " |
| W.nr 1.2367 | 4 | 0.38 | 0.40 | 0.45 | 5.0 | 3.0 | — | — | 0.6 | — | " |
| W.nr 1.2889/H19 | 5 | 0.45 | 0.40 | 0.40 | 4.5 | 3.0 | — | — | 2.0 | 4.5 | " |
| W.nr 1.2888 | 6 | 0.20 | 0.25 | 0.50 | 9.5 | 2.0 | 5.5 | | — | 10.0 | " |
| W.nr 1.2731 | 7 | 0.50 | 1.35 | 0.70 | 13.0 | — | 2.1 | 13.0 | 0.7 | — | " |
| H42 | 8 | 0.60 | 0.30 | 0.30 | 4.0 | 5.0 | 6.0 | | 2.0 | | " |
| Com. 1* | 9 | 0.35 | 0.1 | 0.6 | 5.5 | 3.0 | — | — | 0.8 | — | " |
| Com. 2* | 10 | 0.32 | 0.3 | 0.6 | 5.1 | 2.6 | — | — | 0.7 | — | " |
| Com. 3* | 11 | 0.39 | 0.2 | 0.7 | 5.2 | 2.2 | — | 0.6 | 0.8 | 0.6 | " |
| W.nr 1.2396 | 12 | 0.28 | 0.40 | 0.45 | 5.0 | 3.0 | — | — | 0.7 | — | " |
| W.nr 1.2999 | 13 | 0.45 | 0.30 | 0.50 | 3.1 | 5.0 | — | — | 1.0 | — | " |
| QRO ® 90* | 14 | 0.39 | 0.30 | 0.75 | 2.6 | 2.25 | — | — | 0.9 | — | " |
| CALMAX ® * | 15 | 0.28 | 0.60 | 0.40 | 11.5 | — | 7.5 | — | 0.55 | 9.5 | " |
| H11 | 16 | 0.40 | 1.0 | 0.25 | 5.3 | 1.4 | — | — | 0.4 | — | " |
| Com. 4* | 17 | 0.37 | 0.30 | 0.35 | 5.1 | 1.3 | — | — | 0.5 | — | " |
| Com. 5* | 18 | 0.35 | 0.17 | 0.50 | 5.2 | 1.6 | — | — | 0.45 | — | " |

*Commercially available, non-standard steel. QRO ® 90 and CALMAX ® are registered trademarks of Uddeholm Tooling AB.

DESCRIPTION OF INVENTION

In the first phase of the invention, the steels 1–15 in Table 1 were studied. This study indicated that none of the steels studied satisfied the demands that can be placed on tools for all the different areas of application mentioned above. Consequently, subsequent work concentrated on the development of an alloy primarily intended for die casting of light metals, an area of application where there is a special need of a new steel material with a combination of properties that is better than that currently available using known steels. The objective of the steel material in accordance with the

- it should have good coating properties with PVD/CVD/nitriding,
- it should have good spark erosion properties, good cutting and welding properties, and
- it should have a favourable manufacturing cost The above-mentioned conditions can be satisfied by the invented steel material for the following reasons: firstly, by the steel alloy having such a basic composition that the material can be processed in order to yield an adequate microstructure with very even distribution of carbides in a ferritic matrix, suitable for further heat treatment of the finished tool; secondly, by the steel material with the said basic composition also having the prescribed low contents of silicon, which is to be regarded as an impurity in the steel of the invention, and also very low contents of the non-metallic impurities nitrogen, oxygen, phosphor and sulphur. Indeed it has long been known that non-metallic impurities, such as sulphur, phosphor, oxygen and nitrogen, involve certain negative effects for many steels, especially regarding the toughness of the steel. This also applies concerning the knowledge that some metals in trace element levels may have negative effects for many steels, such as reduced toughness. For instance, this applies in relation to titanium, zirconium and niobium at small levels. Nonetheless, it has not been possible in the case of most steels, including hot work steel, to improve toughness significantly solely by reduction of contents of impurities of this nature in steel. The study conducted of existing steel alloys has also demonstrated that good toughness cannot be attained solely by optimising the basic composition of the steel alloy. It was only possible to attain the said conditions by a combination of an optimal basic composition and low or very low contents of the said non-metallic impurities, and also preferably a very low content of titanium, zirconium and niobium.

In order to satisfy the above-mentioned conditions the invented steel material has an alloy composition that by weight-percentage essentially consists of:

0.3–0.4 C, preferably 0.33–0.37 C, typically 0.35 C 0.2–0.8 Mn, preferably 0.40–0.60 Mn, typically 0.50 Mn 4–6 Cr, preferably 4.5–5.5 Cr, suitably 4.85–5.15 Cr, typically 5.0 Cr 1.8–3 Mo, preferably max. 2.5 Mo, suitably 2.2–2.4 Mo, typically 2.3 Mo 0.4–0.6 V, preferably 0.5–0.6 V, suitably 0.55 V, balance iron and unavoidable metallic and non-metallic impurities, in connection said non-metallic impurities comprising silicon, nitrogen, oxygen, phosphor and sulphur, which may be included up to the following maximum contents:

max. 0.25 Si, preferably max. 0.20 Si, suitably max. 0.15 Si max. 0.010 N, preferably max. 0.008 N max. 10 ppm O, preferably max. 8 ppm O max. 0.010 P, preferably max. 0.008 P, and max. 0.010 S, preferably max. 0.0010, suitably max. 0.0005 S It is preferable that titanium, zirconium and niobium occur in the following maximum contents by weight-% max. 0.05 Ti, preferably max. 0.01, suitably max. 0.008, and most preferably max. 0.005, max. 0.1, preferably max. 0.02, suitably max. 0.010, and most preferably 0.005 Zr, max. 0.1, preferably max. 0.02, suitably max. 0.010, and most preferably max. 0.005 Nb.

As regards the choice of individual desirable alloy elements, it can be briefly stated that the contents of carbon, chromium, molybdenum and vanadium have been chosen so that the steel should have a ferritic matrix in the delivery condition of the material, a martensitic matrix with adequate hardness after hardening and tempering, absence of primary carbides but the existence of secondary precipitated carbides of MC and $M_{23}C_6$ type of sub-microscopic size in the hardened and tempered material, while at the same time the basic composition of the steel shall provide potential in order to also attain the desired toughness.

The minimum content of chromium shall be 4%, preferably 4.5% and suitably at least 4.85% in order that the steel should have adequate hardenability but may not be included at contents exceeding 6%, preferably max. 5.5% and suitably max. 5.15% in order that the steel should not result in carbide content of type $M_{23}C_6$ and $M_7C_3$ to an undesirable extent after tempering. The nominal chromium content is 5.0%.

Tungsten adversely affects thermal conductivity and hardenability in relation to molybdenum and is therefore not a desirable element in the steel but may be permitted in contents up to 0.5%, preferably max. 0.2%. However, the steel should suitably not contain any intentionally added tungsten, i.e. the most desirable form of the steel only contains tungsten at impurity levels.

Molybdenum should be included at a minimum content of 1.8%, preferably at least 2.2% in order to provide adequate hardenability and tempering resistance together with the desirable high temperature strength properties. Greater contents of molybdenum than 3% carry a risk of grain boundary carbides and primary carbides, which reduce toughness and ductility. Molybdenum should therefore not be included at higher contents than 3.0%, preferably max. 2.5%, suitably max. 2.4%. If the steel contains a certain content of tungsten in accordance with the above, tungsten partly substitutes molybdenum in accordance with the rule "two parts tungsten corresponds to one part molybdenum".

The steel shall contain a content of at least 0.4% vanadium to provide an adequate tempering resistance and desired high temperature strength properties. Furthermore, the vanadium content should be at least the stated content to prevent grain coarsening when heat treating the steel. The upper limit for vanadium of 0.6% is set to reduce the risk of formation of primary and grain boundary carbides and/or carbonitrides, which would reduce the ductility and toughness of the steel. The steel should preferably contain 0.5–0.6 V, suitably 0.55 V.

The steel should contain manganese in the stated levels, primarily to increase the hardenability to some degree.

In order to utilise the potential good toughness that a steel material with the said contents of carbon, manganese, chromium, molybdenum and vanadium can provide, the contents on the said non-metallic impurities should at the same time be held at the said low or very low levels. The following may be said regarding the significance of these elements of impurity.

Silicon can be found as a residual product in the steel from its de-oxidation and may be included at a highest level of 0.25%, preferably max. 0.20% and suitably max. 0.15% in order that the carbon activity should be kept low and consequently even the content of primary carbides that can be precipitated during the solidification process, and, at a later phase, also the grain boundary carbides, which improves toughness.

Nitrogen is an element that tends to stabilise primary carbide formation. Primary carbonitrides, in particular carbonitrides in which, besides vanadium, titanium, zirconium and niobium may be included, are more difficult to dissolve than pure carbides. These carbides, if they are present in the finished tool, may have a major negative effect on the impact toughness of the material. With very low contents of nitrogen, these carbides are dissolved more readily on the austenitizing of the steel in conjunction with heat treatment, following which the said small secondary carbides, primarily MC and $M_{23}C_6$ type of sub-microscopic size, i.e. less than 100 nm, normally 2–100 nm, are precipitated, which is advantageous. The steel material according to the invention should therefore contain max. 0.010% N, preferably max 0.008% N.

Oxygen in the steel forms oxides, which can initiate fractures as a result of thermal fatigue. This negative effect on ductility is counteracted by a very low content of oxygen, max. 10 ppm O, preferably max. 8 ppm O.

Phosphor segregates in phase boundary surfaces and grain boundaries of all kinds and reduces cohesion strength and consequently toughness. Phosphor content should therefore not exceed 0.010%, preferably max. 0.008%.

Sulphur which by combining with manganese forms manganese sulphides, has a negative effect on ductility but also on toughness because it influences transverse properties negatively. Sulphur may therefore exist in an amount of max 0.010%, preferably max 0.0010%, suitably max. 0.0008%.

Titanium, zirconium and niobium content ought not to exceed levels in the steel higher than the maximum contents mentioned above, i.e. max. 0.05% Ti, preferably max. 0.01, suitably max. 0.008 and most preferably max. 0.005 Ti, max. 0.1, preferably max. 0.02, suitably max. 0.010 and most suitably 0.005 Zr and max. 0.1, preferably max. 0.02, suitably max. 0.010,and most preferably max. 0.005 Nb, in order to avoid the formation of nitrides and carbonitrides primarily.

In its delivery condition, the steel material according to the invention has a ferritic matrix with evenly distributed carbides, that are dissolved on the heat treatment of the steel in conjunction with hardening. On this heat treatment the steel is austenitized at a temperature between 1000 and 1080° C., suitably at a temperature of 1020–1030° C. The material is thereafter cooled to room temperature and tempered one or several times, preferably 2×2 h, at 550–650° C., preferably at approx. 600° C.

Further characteristics and aspects of the invention will be apparent from the following description of experiments conducted and from the appending patent claims.

BRIEF DESCRIPTION OF DRAWINGS

In the following description of performed experiments, reference is made to the accompanying drawings, of which.

DESCRIPTION OF EXAMINATIONS CONDUCTED

Figure 1:
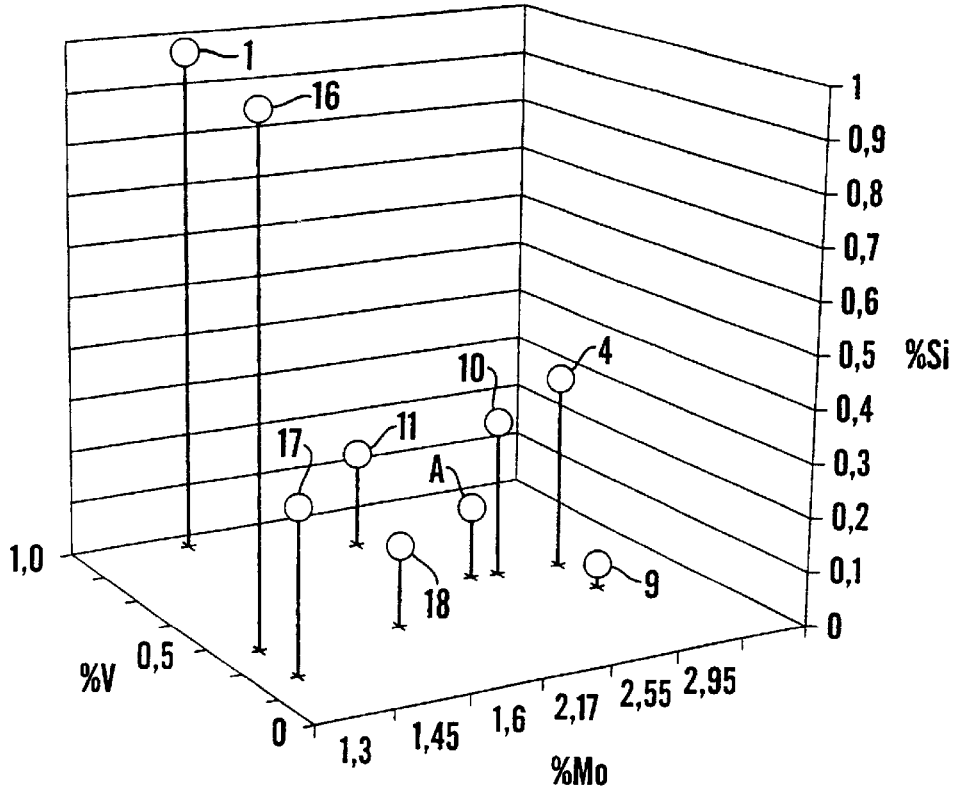
FIG. 1 is a three-dimensional diagram illustrating the nominal contents of silicon, molybdenum and vanadium of a number of steels studied.

The chemical compositions of the examined steels are stated in Table 2

TABLE 2

Analysed chemical composition in weight percentage of steels examined

| Steel type | Steel No. | C | Si | Mn | P | S | Cr | Ni | Mo | W |
|---|---|---|---|---|---|---|---|---|---|---|
| A | A1 | 0.35 | 0.15 | 0.51 | 0.006 | 0.0001 | 5.05 | 0.06 | 2.38 | 0.01 |
| Invention | A2 | 0.36 | 0.17 | 0.51 | 0.006 | 0.0003 | 5.04 | 0.06 | 2.34 | 0.01 |
| | A3 | 0.37 | 0.17 | 0.51 | 0.007 | 0.0001 | 5.06 | 0.07 | 2.40 | 0.01 |
| | A4 | 0.35 | 0.19 | 0.52 | 0.006 | 0.0003 | 5.08 | 0.06 | 2.35 | 0.01 |
| | A5 | 0.37 | 0.17 | 0.53 | 0.008 | 0.0002 | 5.11 | 0.06 | 2.38 | 0.01 |
| | A6 | 0.35 | 0.10 | 0.50 | 0.007 | 0.0002 | 4.98 | 0.06 | 2.33 | 0.01 |
| H11 "Premium" | 16X | 0.39 | 1.06 | 0.41 | 0.006 | 0.0001 | 4.96 | 0.09 | 1.32 | 0.01 |
| H13 "Premium" | 1X | 0.40 | 1.10 | 0.41 | 0.008 | 0.0003 | 5.13 | 0.10 | 1.46 | 0.01 |
| QRO 90 ® | 14X | 0.39 | 0.33 | 0.74 | 0.007 | 0.0003 | 2.64 | 0.07 | 2.29 | 0.01 |
| W.nr 1.2367 | 4X | 0.38 | 0.43 | 0.42 | 0.016 | 0.0004 | 5.08 | 0.09 | 2.84 | 0.03 |
| Com. 4 | 17X | 0.37 | 0.30 | 0.35 | 0.006 | 0.0003 | 5.08 | 0.08 | 1.33 | 0.01 |
| Com. 3 | 11X | 0.36 | 0.21 | 0.57 | 0.007 | 0.0007 | 5.26 | 0.67 | 2.17 | 0.01 |
| Com. 2 | 10X | 0.36 | 0.34 | 0.56 | 0.008 | 0.0005 | 5.03 | 0.09 | 2.55 | 0.01 |
| Com. 1 | 9X | 0.34 | 0.07 | 0.60 | 0.006 | 0.0014 | 5.46 | 0.07 | 2.94 | 0.01 |
| Com. 5 | 18X | 0.35 | 0.17 | 0.48 | 0.007 | 0.0048 | 5.19 | 0.07 | 1.63 | 0.01 |

| Steel type | Steel No. | Co | V | Ti | Zr | Nb | Cu | Al | N | O ppm | Fe |
|---|---|---|---|---|---|---|---|---|---|---|---|
| A | A1 | 0.02 | 0.57 | 0.002 | 0.001 | 0.001 | 0.04 | 0.008 | 0.007 | 5 | Bal |
| Invention | A2 | 0.02 | 0.67 | 0.002 | 0.001 | 0.001 | 0.04 | 0.016 | 0.007 | 4 | Bal |
| | A3 | 0.02 | 0.57 | 0.002 | 0.001 | 0.001 | 0.04 | 0.038 | 0.007 | 5 | Bal |
| | A4 | 0.02 | 0.55 | 0.002 | 0.001 | 0.001 | 0.06 | 0.015 | 0.008 | 5 | Bal |
| | A5 | 0.02 | 0.57 | 0.001 | 0.001 | 0.001 | 0.06 | 0.016 | 0.008 | 3 | Bal |

TABLE 2-continued

| Analysed chemical composition in weight percentage of steels examined | | | | | | | | | | | |
|---|---|---|---|---|---|---|---|---|---|---|---|
| | A6 | 0.02 | 0.54 | 0.002 | 0.001 | 0.001 | 0.04 | 0.017 | 0.007 | 6 | Bal |
| H11 "Premium" | 16X | 0.02 | 0.38 | 0.003 | 0.001 | 0.002 | 0.06 | 0.07 | 0.009 | 7 | Bal |
| H13 "Premium" | 1X | 0.02 | 0.92 | 0.004 | 0.001 | 0.002 | 0.06 | 0.031 | 0.008 | 6 | Bal |
| QRO 90 ® | 14X | 0.02 | 0.83 | 0.002 | 0.001 | 0.001 | 0.07 | 0.032 | 0.007 | 10 | Bal |
| W.nr 1.2367 | 4X | 0.02 | 0.66 | 0.003 | 0.003 | 0.001 | 0.06 | 0.064 | 0.015 | 12 | Bal |
| Com. 4 | 17X | 0.01 | 0.49 | 0.001 | 0.002 | 0.002 | 0.02 | 0.005 | 0.013 | 6 | Bal |
| Com. 3 | 11X | 0.57 | 0.86 | 0.002 | 0.003 | 0.001 | 0.03 | 0.005 | 0.025 | 13 | Bal |
| Com. 2 | 10X | 0.03 | 0.63 | 0.002 | 0.002 | 0.001 | 0.05 | 0.020 | 0.018 | 8 | Bal |
| Com. 1 | 9X | 0.01 | 0.83 | 0.003 | 0.002 | 0.001 | 0.05 | 0.017 | 0.013 | 10 | Bal |
| Com. 5 | 18X | 0.01 | 0.45 | 0.002 | 0.002 | 0.001 | 0.04 | 0.011 | 0.012 | 20 | Bal |

In Table 2, H11 "Premium" and H13 "Premium" are variants of steel of type AISI H13 and H11 respectively. "Premium" means that the steel melts in connection with manufacture have been treated through SiCa injection, which brings about extremely low levels of sulphur content, and that the finished products have undergone a modified hot working procedure. The steels are characterised, in comparison to standard steels of the same type, by a higher level of toughness in all directions, greater potential to utilise higher hardness with maintained toughness and higher thermal shock resistance.

Two heats were produced from steel of type A of the invention, and of these heats three ingots were produced by ESR remelting. These have been called A1, A2 . . . A6 in Table 2. The examinations described have been primarily concentrated on steel A2. In those cases when reference is made to steel A, it is the matter of a mean value of the result of the examinations of a greater number of the steels A1–A6. The melt metallurgical treatment corresponded essentially with the processing applied for H11 "Premium" and H13 "Premium". The ESR heats had weights varying between 480 and 6630 kg. Bars were produced from these ingots of various forms through forging and rolling.

The six last steels in Table 2, the steels 4X, 17X, 11X, 10X 9X and 18X, are materials that were acquired by the applicant on the market and the chemical composition of which have been analysed by the applicant.

All the steels, except QRO® 90 have a chromium content in the order of 5%. Other steels examined differ from each other by varying contents of primarily silicon, molybdenum and vanadium. This is illustrated in FIG. 1, which in the form of a three-dimensional coordinate diagram illustrates the nominal contents of silicon, molybdenum and vanadium of these steels. See Table 1 concerning the nominal contents.

The dimensions and also the hardness in softannealed state are indicated by Table 3.

TABLE 3

| Hardness in softannealed state | | |
|---|---|---|
| Steel No. | Dimensions (mm) | Hardness (HB) |
| A3 | 762 × 407 | 164 |
| A3 | 762 × 305 | 162 |
| A2 | 610 × 54 | 159 |
| A2 | 610 × 203 | 164 |
| A2 | 610 × 153 | 157 |
| A2 | 508 × 127 | 163 |
| A1 | Ø508 | 163 |

TABLE 3-continued

| Hardness in softannealed state | | |
|---|---|---|
| Steel No. | Dimensions (mm) | Hardness (HB) |
| A1 | Ø350 | 156 |
| A4 | 762 × 407 | 174 |
| A5 | 762 × 305 | 159 |
| A5 | 700 × 300 | 163 |
| A6 | 610 × 102 | 170 |
| A4 | Ø750 | 170 |
| A6 | Ø270 | 170 |
| A6 | Ø125 | 170 |
| A6 | Ø80 | 170 |
| 16X | 500 × 110 | 192 |
| 1X | 762 × 305 | 174 |
| 14X | 356 × 127 | 174 |
| 4X | 510 × 365 | 183 |
| 17X | ~500 × 200 | 164 |
| 11X | 485 × 200 | 189 |
| 10X | 510 × 210 | 172 |
| 9X | 510 × 210 | 207 |
| 18X | 260 × 210 | 174 |

Figure 2:
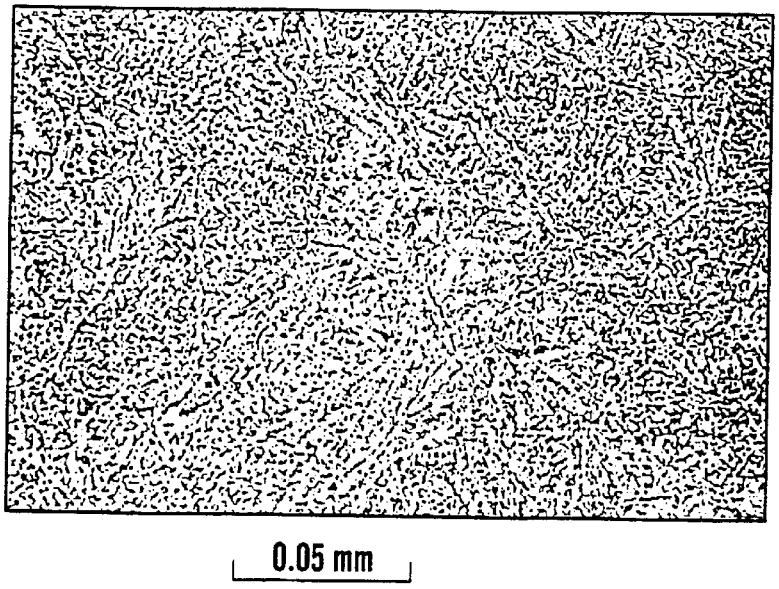
FIG. 2 shows the microstructure in soft-annealed state in the centre of a steel of the invention.

Structure investigations indicated that primary carbide content was zero in all steels with the exception of steel no. 11X and 9X, which contained significant quantities of primary carbides and primary carbonitrides. The microstructure in softannealed state in the centre of the steel no. A2, 610×203 mm, is shown in FIG. 2.

Figure 3:
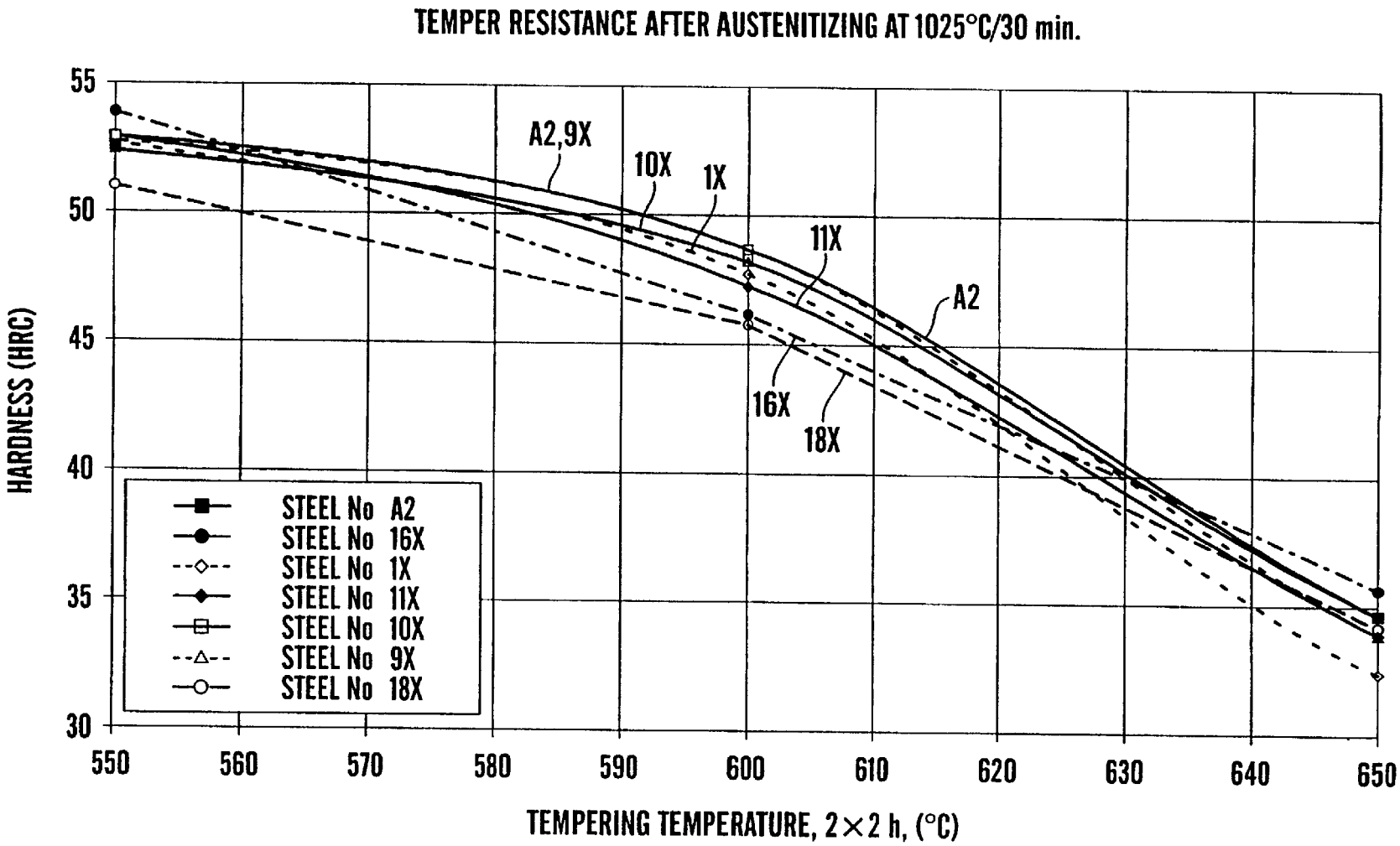
FIG. 3 illustrates the tempering resistance of the examined steels.
Figure 4:
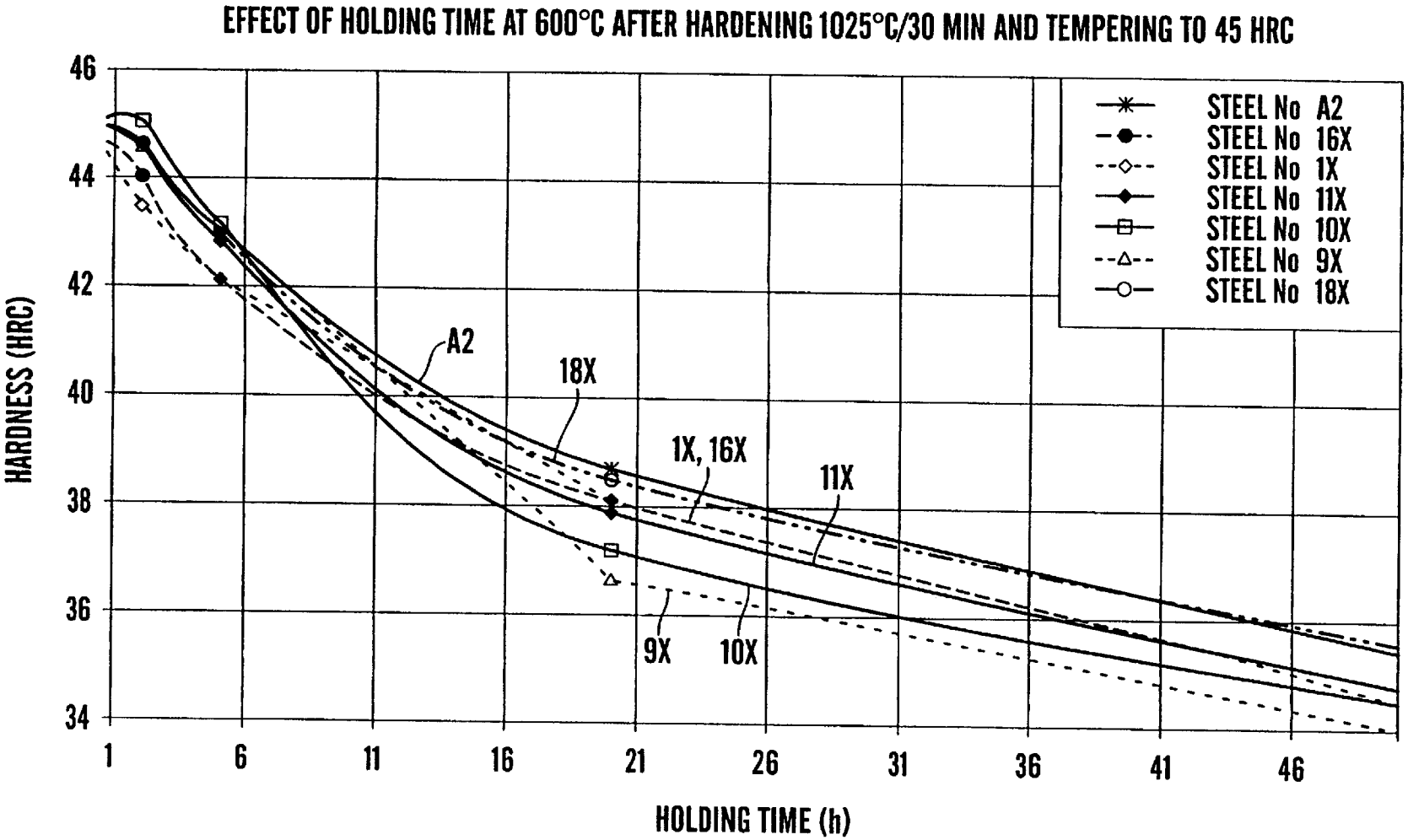
FIG. 4 illustrates the influence on hardness of examined steel of holding time at 600° C. after hardening and tempering.

Tempering resistance after austenitizinc, at 1025° C./30 min. and also the influence of holding time at 600° C. after hardening 1025 ° C./30 min (1010° C. for steel no. 16X) and tempering to 45 HRC is illustrated by the diagram in FIGS. 3 and 4. It is shown by these diagrams that the steel of the invention A2 and steel 9X have the best tempering resistance. The steel A2 of the invention was also affected least by the holding time at 600° C., while steel no. 9X rapidly lost hardness. This also applies to steel no. 10X.

Figure 5:
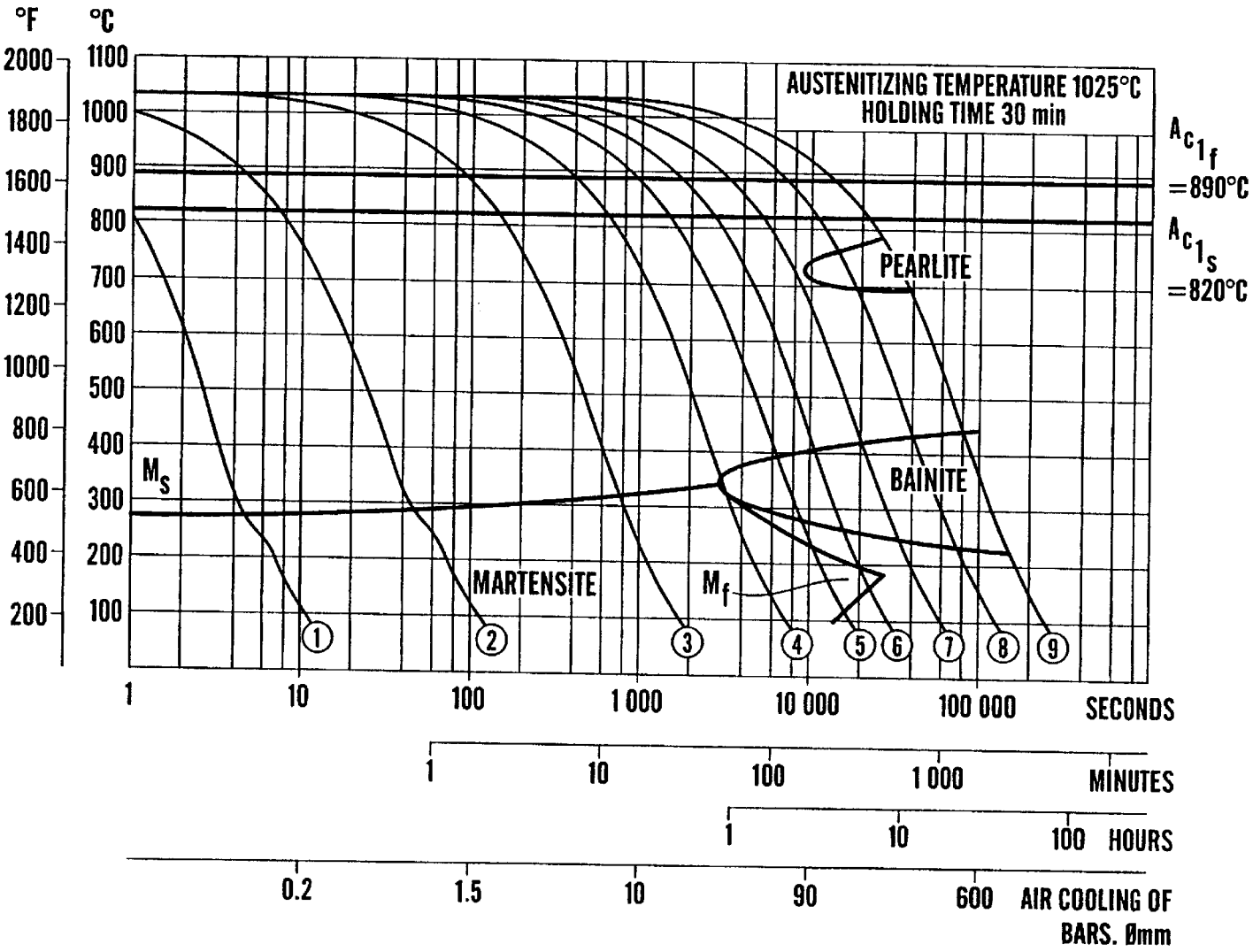
FIG. 5 and FIG. 6 show a CCT diagram and TTT diagram respectively, for a steel of the invention.
Figure 6:
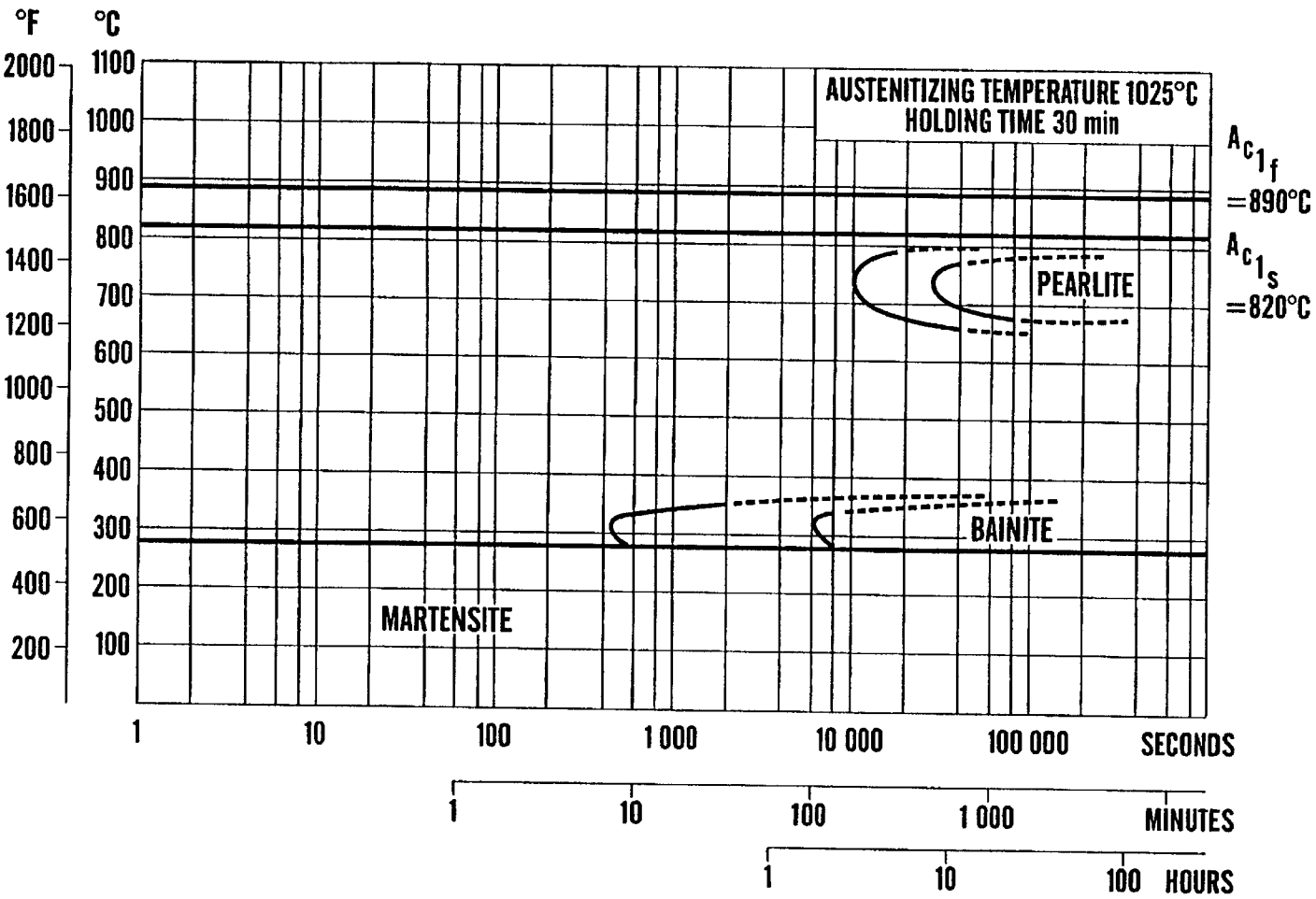

Even hardenability was very good for the steel of the invention A2, as is shown by the CCT and TTT diagrams in FIGS. 5 and 6.

Figure 7:
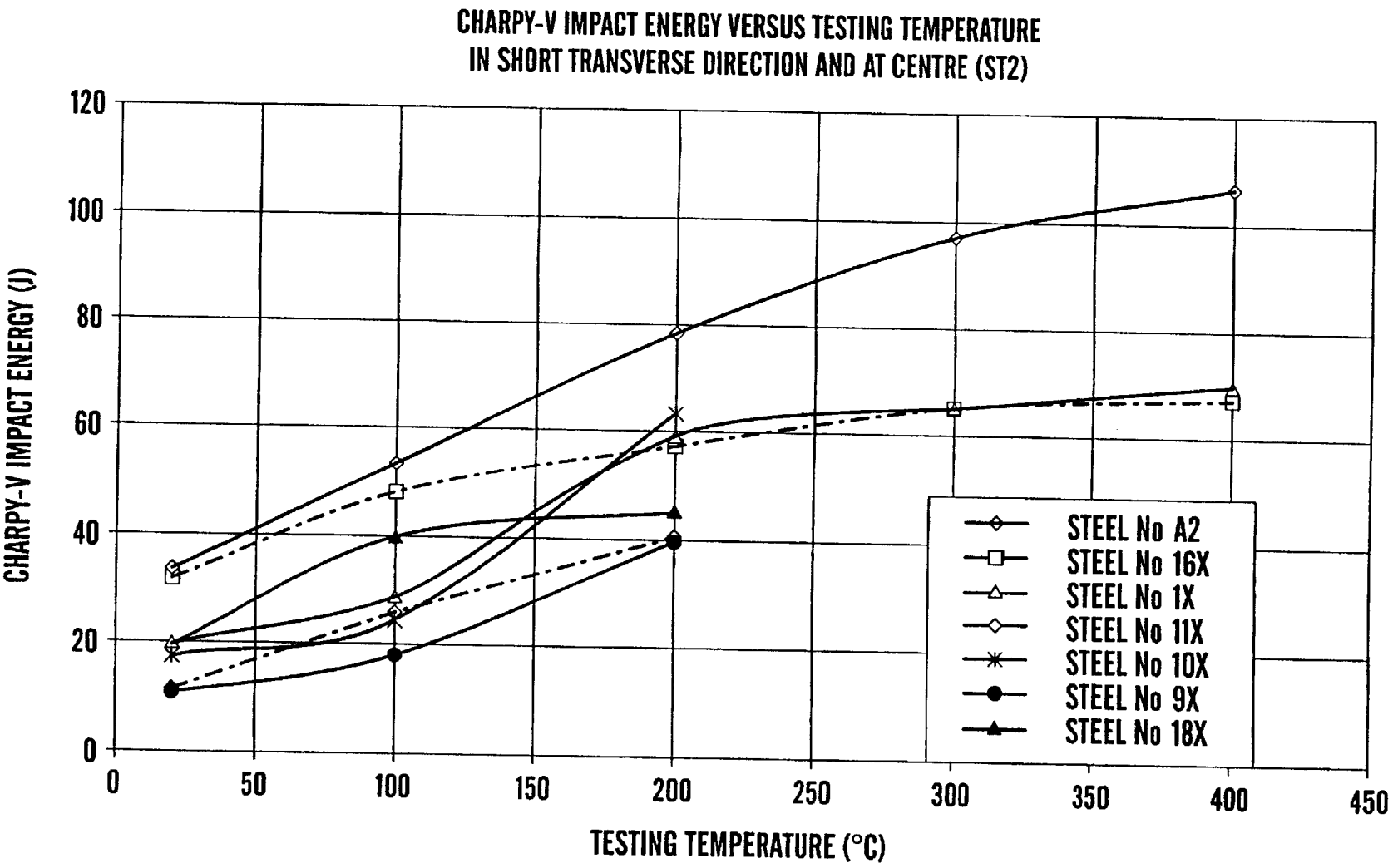
FIG. 7 illustrates Charpy-V impact energy versus testing temperature of steels examined.
Figure 8:
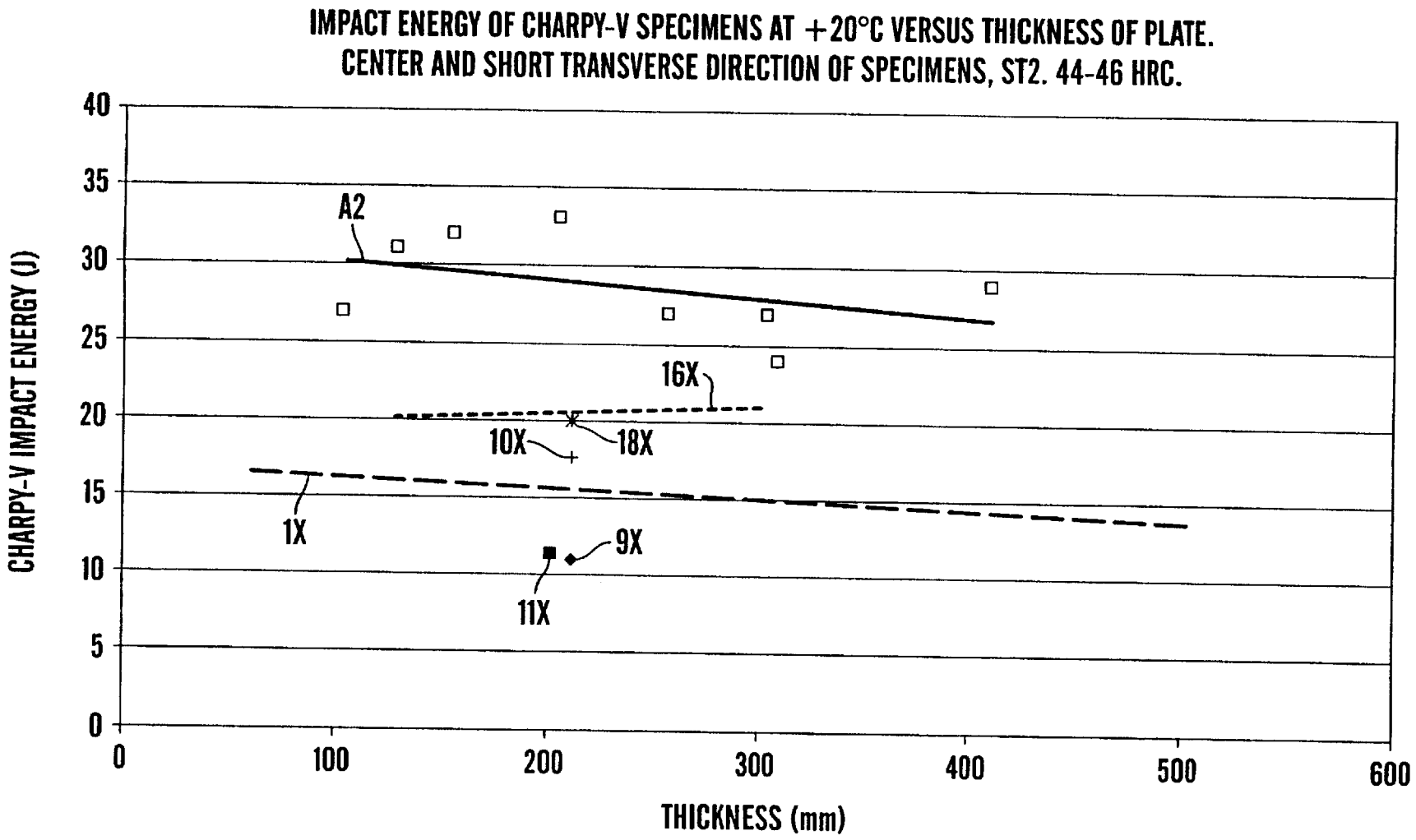
FIG. 8 and FIG. 9 illustrate the impact energy at +20° C. versus the thickness of tested plates with Charpy-V energy tests and tests with unnotched test specimens.

Toughness measurements were conducted as Charpy-V impact energy tests versus testing temperature and the results given in FIGS. 7 and 8 respectively.

Figure 9:
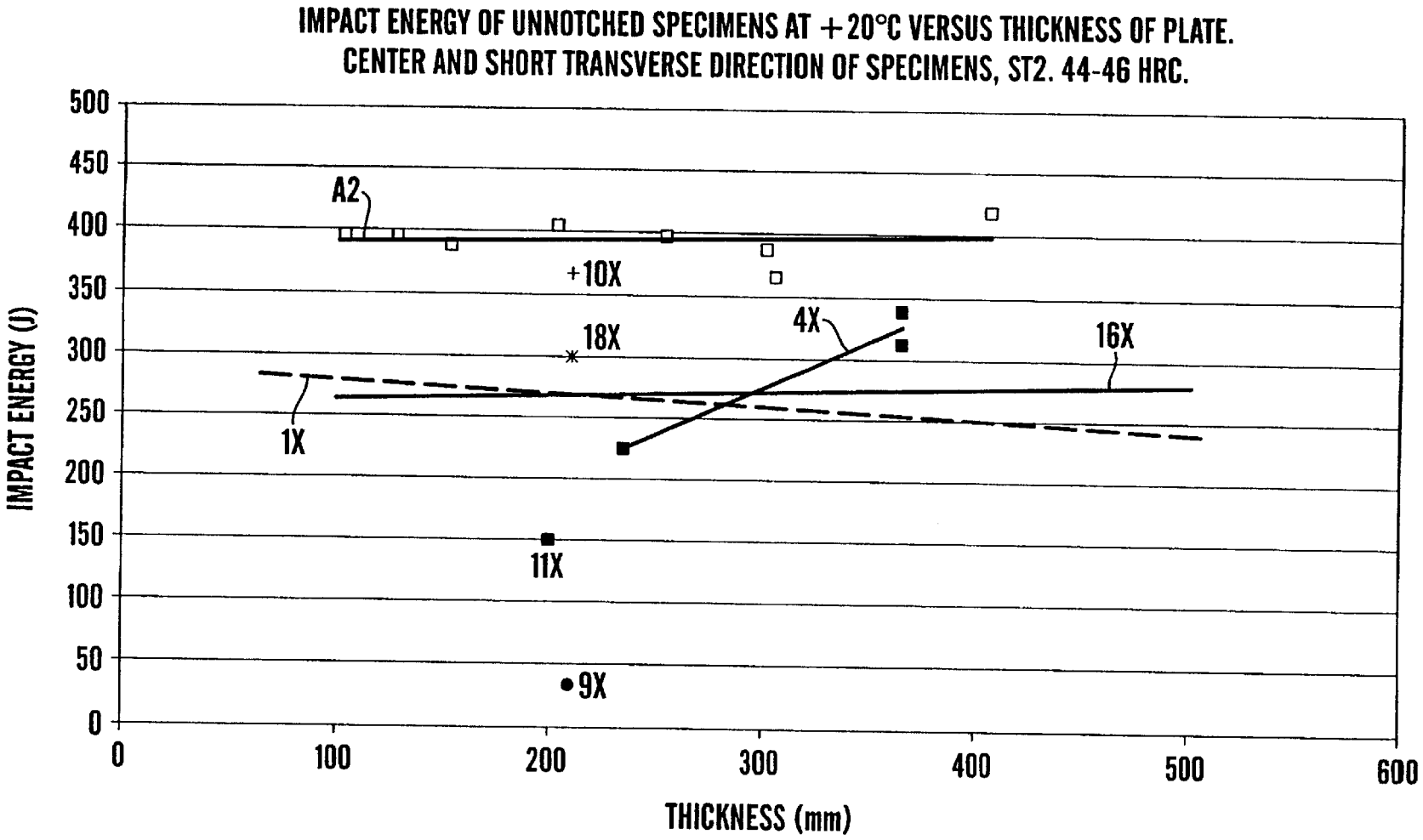

FIG. 9 shows the impact toughness at room temperature for unnotched specimens versus bar dimension. The curves illustrate that the steel of the invention, A2, has superior toughness and ductility among the investigated steels. It should be noted in particular that steel no. 4X in FIG. 9 has been tested in TL1 direction, which gives 10% greater value than specimens taken in ST2 direction.

Figure 10:
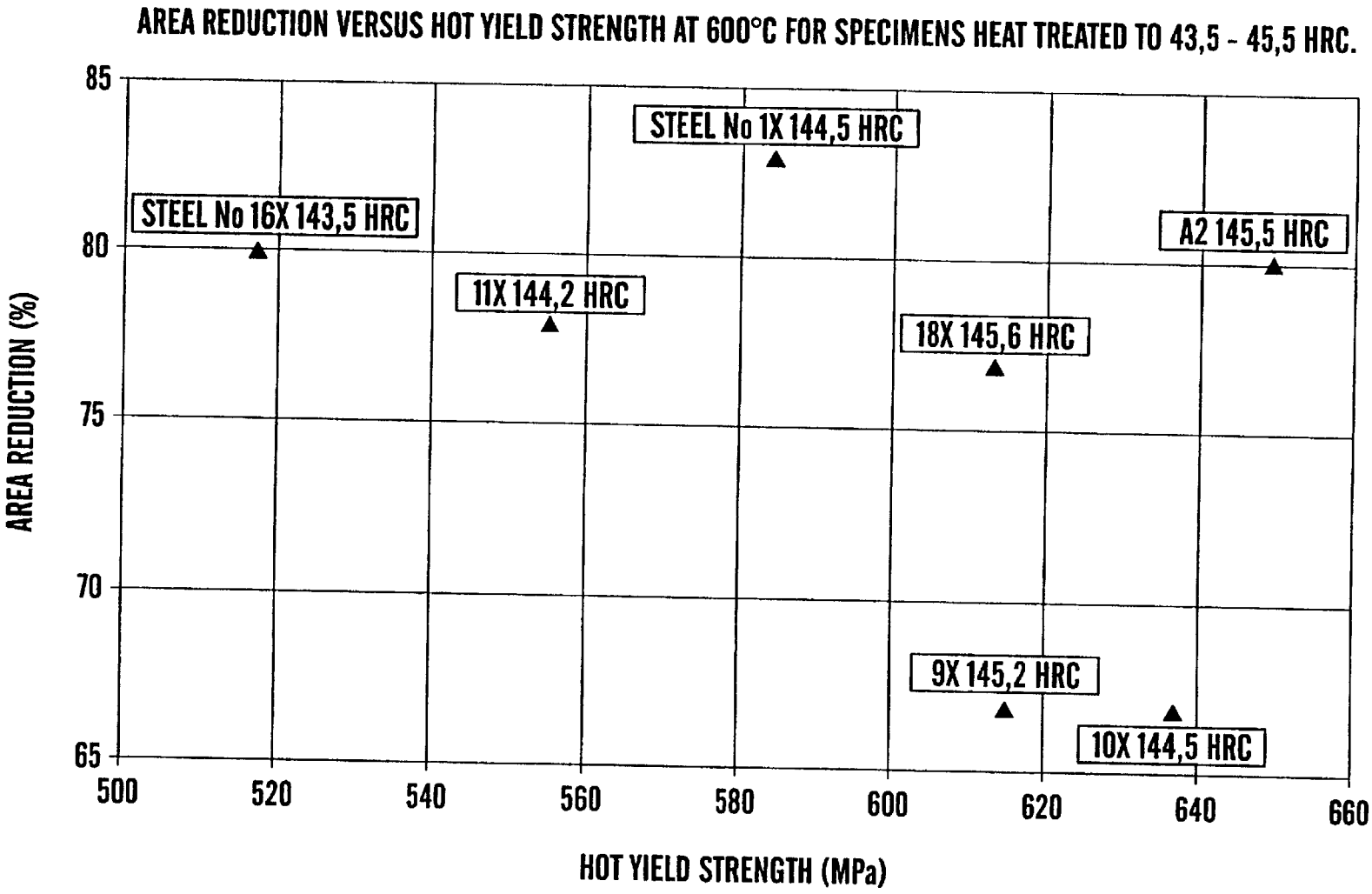
FIG. 10 is a diagram illustrating the hot ductility and hot yield strength of the examined steels.

Hot tensile tests were conducted at 600° C. on specimens that had been heat treated to 45 HRC. The results are shown in Table 4 and in FIG. 10. Even as regards this property, the steel of the invention has significantly better combination of high temperature strength and ductility than the other steels investigated.

TABLE 4

Hot tensile properties after testing at 600° C.

| Steel no. | Hardness (HRC) | $R_{p0.2}$ (Mpa) | $R_m$ (MPa) | $A_s$ (%) | Z (%) |
|---|---|---|---|---|---|
| A2 | 45.5 | 649 | 897 | 17 | 80 |
| 16X | 43.5 | 517 | 715 | 18 | 80 |
| 1X | 44.5 | 584 | 795 | 17 | 83 |
| 11X | 44.2 | 555 | 801 | 17 | 78 |
| 10X | 45.5 | 637 | 896 | 13 | 67 |
| 9X | 45.2 | 615 | 897 | 14 | 67 |
| 18X | 45.6 | 613 | 859 | 5 | 77 |

Figure 11:
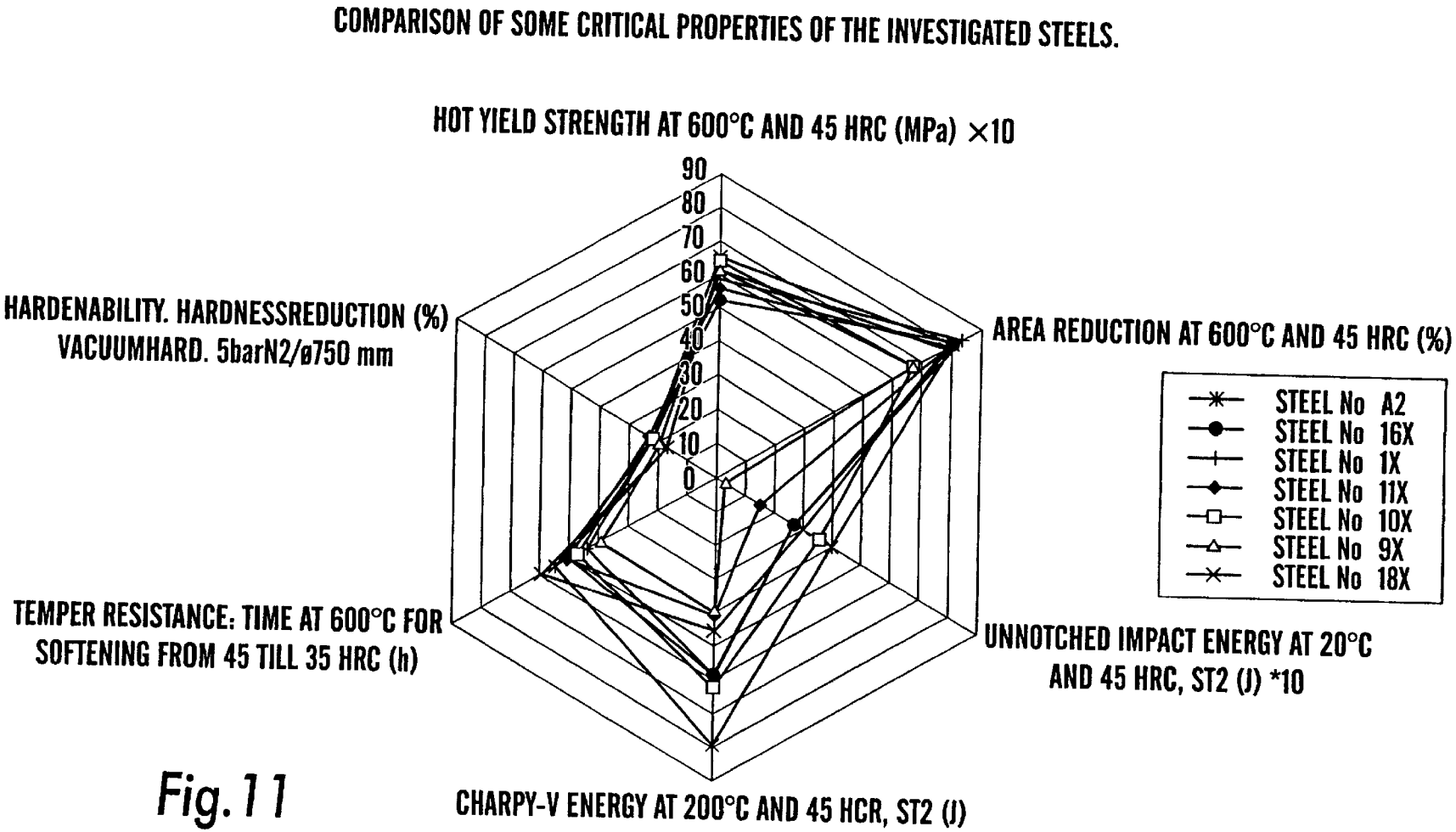
FIG. 11 is a schedule illustrating the property profiles of the examined steels.

Certain critical properties of the invented steels are compared in the polar diagram in FIG. 11. As regards toughness, the steels no. 11X and 9X had high contents of primary carbides and carbonitrides, which have significantly reduced toughness for both of these steels. Steel no. 10X and to a certain extent also steel no. 18X have a toughness that is comparable with that of steel No 1X, but the steel of the invention, A2, has superior ductility and toughness. The latter also has been confirmed by full-scale press-forging tests. On these trials, which related to forging of large truck hub components, a steel of type H13 "Premium" and steel A1 were used as tool material. The number of components manufactured numbered 2452 and 7721 items respectively. The failure mode of H13 "Premium" tools comprised total failure, while the tools of A1 steel were removed from service only as a result of plastic deformation of the die inner diameter.

The invention steel, A2, thus has the best yield strength, ductility (area reduction) and hardenability (in terms of hardness reduction). The tempering resistance is also very good for A2. Among the investigated steels the invention steel, A2, has the best properties profile.

Without tying the invention to any particular theory, it can be assumed that this superior properties profile may be the result of the following factors:

- a balanced chemical composition of carbide forming elements such as chromium, molybdenum and vanadium aimed at, providing an excellent soft-annealed initial structure for the subsequent tool hardening, thereby achieving a very good hardenability and good tempering resistance and high temperature strength properties,
- absence of primary carbides and/or primary carbonitrides of MX type where M is vanadium and X is carbon and/or nitrogen, by optimal choice of carbon and vanadium contents together with a low nitrogen content,
- a comparatively high content of molybdenum, a relatively low content of carbon and a very low silicon content, which reduces carbon activity and thereby the tendency to precipitation of toughness reducing primary carbides and grain boundary precipitations,
- a low content of elements such as oxygen, nitrogen and sulphur, which form toughness reducing oxides, nitrides and sulphides,
- a low content of elements causing temper brittleness, such as phosphor.

What is claimed is:

1. Steel material for hot work tools, characterised in that it has an alloy composition that in weight-% essentially consists of:

0.3–0.4 C 0.2–0.8 Mn

4–6 Cr 1.8–2.5 Mo 0.4–0.6 V balance iron and unavoidable metallic and non-metallic impurities, said metallic impurities comprising titanium, zirconium and niobium, which may be present in the following maximum amounts:

max 0.01 Ti max 0.02 Zr max 0.02 Nb and said non-metallic impurities comprising silicon, nitrogen, oxygen, phosphor and sulphur, which may be present in the following maximum amounts:

max. 0.25 Si max. 0.010 N max. 10 ppm O max. 0.010 P max 0.010 S.

2. Steel material in accordance with claim 1, characterised in that it contains max. 0.20 Si.

3. Steel material in accordance with claim 1, characterised in that it contains max. 0.0010 S.

4. Steel material in accordance with claim 1, characterised in that it contains:

0.33–0.37 C 0.4–0.6 Mn, and 4.5–5.5 Cr.

5. Steel material in accordance with claim 4, characterised in that it contains 4.85–5.15 Cr and 2.2–2.4 Mo.

6. Steel material in accordance with claim 1, characterised in that it contains max. 0.008 N.

7. Steel material in accordance with claim 1, characterised in that it contains max. 8 ppm O.

8. Steel material in accordance with claim 1, characterised in that it contains max. 0.008 P.

9. Steel material in accordance with claim 1, characterised in that it contains max. 0.0008 S.

10. Steel material in accordance with claim 1, characterised in that it contains 0.35 C, max. 0.15 Si, 0.5 Mn, max. 0.0008 S, 5 Cr, 2.3 Mo, 0.55 V, max. 0.008 N, max. 8 ppm O.

11. Steel material in accordance with claim 1, characterised in that it contains max. 0.008 Ti, max. 0.016 Zr, and max. 0.010 Nb.

12. Steel material in accordance with claim 1, characterised in that it contains 0.5–0.6 V.

* * * * *